United States Patent [19]

Horita

[11] Patent Number: 4,987,658

[45] Date of Patent: Jan. 29, 1991

[54] SLIDE FASTENER

[75] Inventor: Yoshiyuki Horita, Toyama, Japan

[73] Assignee: Yoshida Kogyo, K.K., Tokyo, Japan

[21] Appl. No.: 480,917

[22] Filed: Feb. 16, 1990

[30] Foreign Application Priority Data

Feb. 20, 1989 [JP] Japan ..... 1-39770

[51] Int. Cl.[5] ..... A44B 19/02

[52] U.S. Cl. ..... 24/403; 24/405

[58] Field of Search ..... 24/403, 405, 414, 381

[56] References Cited

U.S. PATENT DOCUMENTS

| | | | |
|---|---|---|---|
| 1,902,416 | 3/1933 | Norton . | |
| 1,983,070 | 12/1934 | Cox | 24/405 |
| 2,041,149 | 5/1936 | Reuter . | |
| 2,041,558 | 5/1936 | Marinsky | 24/405 |
| 2,245,335 | 6/1941 | Frey | 24/403 |
| 2,335,668 | 11/1943 | Hamm . | |
| 2,993,252 | 7/1961 | De Held | 24/405 |
| 3,340,121 | 9/1967 | Lawrenz . | |
| 4,325,982 | 4/1982 | Gillette et al. . | |
| 4,742,603 | 5/1988 | Kasai | 24/434 |

FOREIGN PATENT DOCUMENTS

| | | |
|---|---|---|
| 0299500 | 1/1989 | European Pat. Off. . |
| 2729088 | 1/1978 | Fed. Rep. of Germany . |
| 55776 | 9/1952 | France . |

*Primary Examiner*—Victor N. Sakran

*Attorney, Agent, or Firm*—Hill, Van Santen, Steadman & Simpson

[57] ABSTRACT

A slide fastener comprising a pair of stringer tapes carrying rows of discrete coupling elements along their respective longitudinal inner edges and a slider reciprocably movable along the rows of elements to open and close the fastener. A decorative coat is deposited with heat and pressure upon the coupling element and specifically extends at least partially into a rear and region of the coupling element to ensure freedom of separation of the cost from the skin of the coupling element.

2 Claims, 2 Drawing Sheets

SLIDE FASTENER

BACKGROUND OF THE INVENTION

1. Field of the Invention

This invention relates to slide fasteners and particularly such a slide fastener which exhibits an ornamental effect.

2. Prior Art

Ornamentally attractive slide fasteners have hitherto been proposed for use on a variety of articles such us garments, shoes, bags and the like. Such slide fasteners feature coupling elements, a component part thereof, which are formed from either metals of various intrinsic colors, plated or otherwise chemically surface-treated, or plastics materials plated or colored with use of coloring agent.

While plating is popular for providing glossy metallic appearance on the slide fastener coupling elements, this process is intricate and rather costly.

SUMMARY OF THE INVENTION

It is therefore the primary object of the present invention to provide a slide fastener having ornamentally finished coupling elements which can be provided in a relatively simple and less costly manner.

It is another object of the invention to provide a slide fastener having ornamentally finished coupling elements which have decorative surface layers immune to separation in sliding contact with a slider.

According to the invention, there is provided a slide fastener comprising a pair of stringer tapes and rows of discrete coupling elements secured respectively to longitudinal inner edges and of the stringer tapes and a slider reciprocably movable along the rows of coupling elements each of the coupling elements having at one end a bulged coupling head portion, a barrel portion and a heel portion and a decorative coat deposited over an upper surface of the coupling element and extending at least partially into a vertical rear end region of the heel portion, beyond a corner region into a vertical front end region of said coupling head portion, beyond a corner region into a vertical rear end region of said heel portion, and further partially into opposite vertical side regions of said coupling element.

The above and other objects and features of the invention will appear clear form the following detailed description taken in conjunction with the accompanying drawings which illustrates by way of example a preferred embodiment which the invention may assume in practice.

BRIEF DESCRIPTION OF THE INVENTION

DETAILED DESCRIPTION OF THE INVENTION

Figure 1:
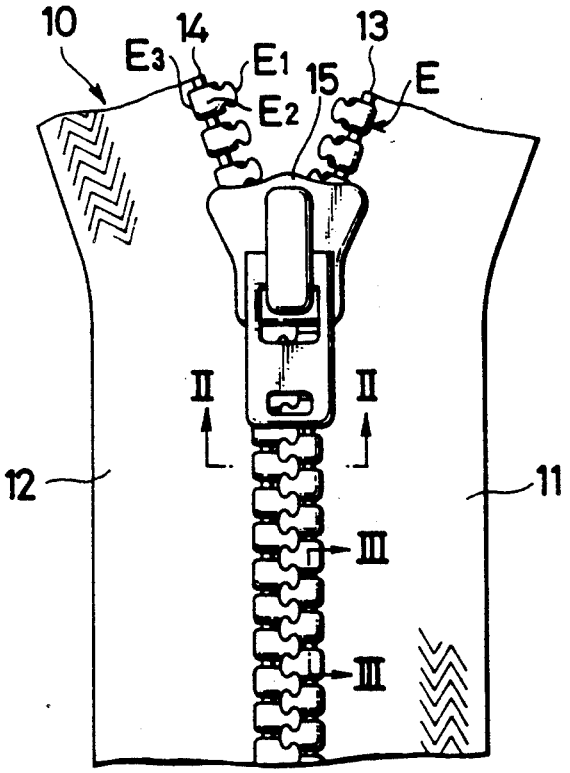
FIG. 1 is a fragmentary plan view of a slide fastener.

Referring now to the drawings and FIG. 1 in particular, there is shown a slide fastener 10 which comprises a pair of stringer tapes 11 and 12 carrying rows of discrete coupling elements E along their respective longitudinal beaded inner edges 13 and 14, a slider 15 reciprocably movable along the rows of elements E to couple or uncouple the latter so as to close or open the slide fastener 10 in a manner well known in the art. The coupling elements may be formed from a metallic or plastic material into individual units each having at one end a bulged coupling head portion $E_1$, a barrel portion $E_2$ and a heel portion $E_3$ at the opposite end. The barrel portion $E_2$ is utilized to mount the element E astride the beaded edge 13, (14) of the stringer tape 11, (12). The coupling head portion $E_1$ of one element E is engageable with corresponding head portions of two neighboring elements. The heel portions $E_3$ serve as guide rails along which the slider 15 is guidedly moved.

Figure 2:
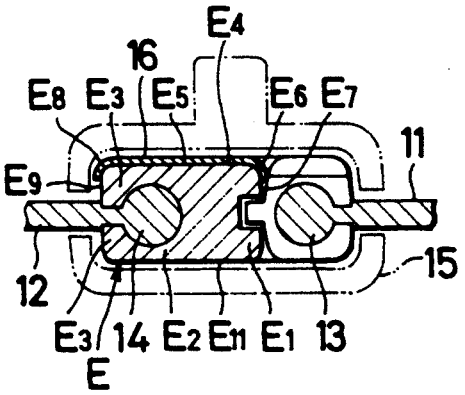
FIG. 2 is a transverse cross-sectional view taken on the line II—II FIG. 1.
Figure 3:
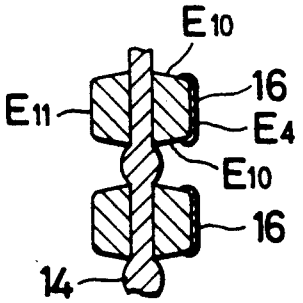
FIG. 3 is a longitudinal cross-sectional view taken on the line III—III FIG. 1.
Figure 4:
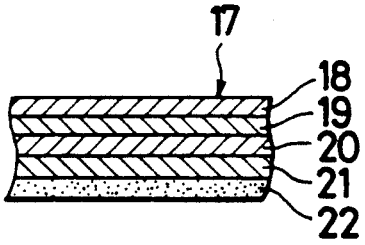
FIG. 4 is a diagrammatic cross-sectional view schematically illustrating a heat transfer film employed in accordance with the invention.

There is provided a decorative coat 16 deposited over an upper surface $E_4$ of each element $E_1$ as shown in FIGS. 2 and 3, which coat is formed from a composite heat transfer film 17 comprising a cover layer 18 such as of polyester, a releasing layer 19, a protective layer 20 such as of lacquer, a depositing metal layer 21 and heat-sensitive adhesive layer 22 superimposed one on another in this order as shown in FIG. 4.

According to an important aspect of the invention, the decorative coat 16 when deposited on the upper surface $E_4$ of the coupling element E extends over a flat horizontal barrel region $E_5$ beyond a corner region $E_6$ into a vertical front end region $E_7$ of the coupling head $E_1$ and beyond a corner region $E_8$ into a vertical rear end region $E_9$ of the heel $E_3$ as shown in FIG. 2. The decorative coat 16 further extends partially into opposite vertical side regions $E_{10}$ of the coupling element E as shown in the longitudinal cross-section of FIG. 3. This coverage of the decorative coat 16 ensures freedom of separation or detachment of the coat 16 from the skin of the coupling element E even when the fastener 10 is repeatedly opened or closed by manipulation of the slider 15.

Figure 7:
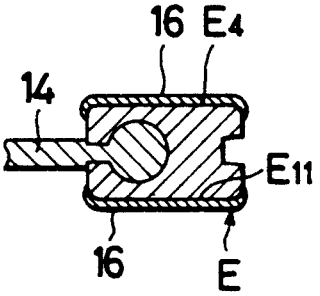
FIG. 7 is transverse cross-sectional view of a fastener coupling element having both of its surfaces deposited with a decorative layer.

If desired, the decorative coat 16 may be applied in a similar manner to both upper surface $E_4$ and lower surface $E_{11}$ of the coupling element E as shown in FIG. 7 in which instance there may be used a decorative coat 16 of one color for the upper surface $E_4$ and a decorative coat 16 of another color for the lower surface $E_{11}$ of the coupling element E so that the resulting slide fastener may be applied desirably for example to a reversibly designed garment.

Figure 5:
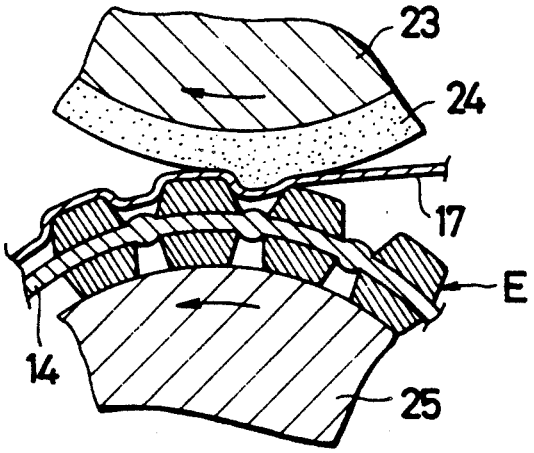
FIG. 5 is a diagrammatic cross-sectional view schematically illustrating an apparatus for applying the heat transfer film of FIG. 4 to a row of discrete fastener coupling elements.
Figure 6:
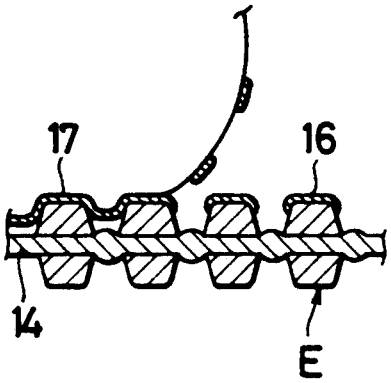
FIG. 6 is a diagrammatic cross-sectional view illustrating how unwanted segments of the heat transfer film are separated and removed.

FIG. 5 schematically illustrates an apparatus comprising a heating roller 23 peripherally lined with silicone resin 24 and a guide roller 25. A chain of stringer tape 11, (12) carrying a row of elements E with the composite heat transfer film 17 laid thereover is fed into the nip between the two rollers 23 and 25 and subjected to heat and pressure such that the adhesive layer 22 melt into and merge with the layers 20 and 21, in which instance the silicone lining 24 of the heating roller 23 deforms on contact with the coupling elements E via the film 17 and urges the film 17 to move toward and cover the peripheral regions $E_7$, $E_9$ and $E_{10}$ of each individual coupling element E. Upon cooling, the cover layer 18 is peeled together with the releasing layer 19 from the decorative coat 16 which has been deposited on the coupling elements E.

While the row of coupling elements E may be treated on a flat surface by the flexible heating roller 23, it is preferable to use an arcuate surface roller such as one shown in FIG. 5 which makes it possible to widen the gap between adjacent elements E thereby facilitating deposition of the composite film 17 over the intended peripheral regions $E_7$, $E_9$ and $E_{10}$ of the coupling elements E and thereby allowing progressive application of pressure to successive elements E so as to prevent rupture of the decorative coat 16 which would otherwise develop if pressure was applied simultaneously over flatly arranged elements E.

Obviously, various modifications and variations of the present invention are possible in the light of the above teaching. It is therefore to be understood that within the scope of the appended claims the invention may be practiced otherwise than as specifically described.

What is claimed is:

1. A slide fastener comprising a pair of stringer tapes, rows of discrete coupling elements secured respectively to longitudinal inner edges and of said stringer tapes and a slider reciprocably movable along said rows of coupling elements, each of said coupling elements having at one end a bulged coupling head portion, a barrel portion and a heel portion, and a decorative coat deposited over an upper surface of said coupling element and extending at least partially into a vertical rear end region of said heel portion, beyond a corner region into a vertical front end region of said coupling head portion, beyond a corner region into a vertical rear end region of said heel portion, and further partially into opposite vertical side regions of said coupling element, wherein said decorative coat is derived from a composite heat transfer film comprising a cover layer, a releasing layer, a protective layer, a depositing metal layer, and a heat sensitive adhesive layer superimposed one on another in this order.

2. A slide fastener according to claim 1 wherein said decorative coat is deposited over both said upper surface and a lower surface of said coupling element and extends at least partially into said vertical rear end region of said heel portion.

* * * * *